US010980327B2

(12) United States Patent
Barclay

(10) Patent No.: US 10,980,327 B2
(45) Date of Patent: Apr. 20, 2021

(54) NAIL POLISH REMOVAL KIT

(71) Applicant: Debra Lynn Barclay, Zephyrhills, FL (US)

(72) Inventor: Debra Lynn Barclay, Zephyrhills, FL (US)

( * ) Notice: Subject to any disclaimer, the term of this patent is extended or adjusted under 35 U.S.C. 154(b) by 0 days.

(21) Appl. No.: 16/243,228

(22) Filed: Jan. 9, 2019

(65) Prior Publication Data

US 2019/0216200 A1 Jul. 18, 2019

Related U.S. Application Data

(60) Provisional application No. 62/709,283, filed on Jan. 12, 2018.

(51) Int. Cl.

| | |
|---|---|
| ***A46B 11/00*** | (2006.01) |
| ***A45D 29/00*** | (2006.01) |
| ***A45D 29/17*** | (2006.01) |
| ***A45D 34/06*** | (2006.01) |
| ***A45D 34/04*** | (2006.01) |

(52) U.S. Cl.

CPC ..... *A45D 29/007* (2013.01); *A45D 29/17* (2013.01); *A45D 34/04* (2013.01); *A45D 34/045* (2013.01); *A45D 34/06* (2013.01); *A45D 2200/1018* (2013.01); *A45D 2200/1063* (2013.01); *A45D 2200/25* (2013.01)

(58) Field of Classification Search

CPC ..... A45D 34/045; A45D 34/046
USPC ..... 401/126, 127
See application file for complete search history.

(56) References Cited

U.S. PATENT DOCUMENTS 6,033,142 A * 3/2000 Gueret ..... A45D 34/046 401/122
7,118,298 B2 * 10/2006 Tsutsumi ..... A45D 34/045 401/129
7,225,814 B2 6/2007 Barclay

* cited by examiner

*Primary Examiner* — Jennifer C Chiang
(74) *Attorney, Agent, or Firm* — Nath, Goldberg & Meyer; Richard C. Litman

(57) ABSTRACT

A nail polish removal kit includes a bottle, a removable lid on the bottle, a wand extending from the lid into the bottle, and one or more flexible daubers. The bottle has an upper portion having a first diameter, a lower portion having a second diameter that is larger than the first diameter, and a neck portion between the upper portion and the lower portion. The neck portion has a diameter that is less than the diameter of the upper portion and the diameter of the lower portion. A tubular passageway with a constant diameter is provided within the neck portion. The wand has a free end with an opening extending therethrough.

17 Claims, 7 Drawing Sheets

NAIL POLISH REMOVAL KIT

CROSS-REFERENCE TO RELATED APPLICATION

This application claims the benefit of U.S. Provisional Patent Application Ser. No. 62/709,283, filed on Jan. 12, 2018.

BACKGROUND

1. Field

The disclosure of the present patent application relates to nail polish removal, and particularly to a kit for minimizing skin exposure to solvent when removing nail polish from finger and toe nails.

2. Description of the Related Art

Conventional methods of removing nail polish are generally messy and often expose the skin to excessive amounts of the nail polish remover. A strong solvent, e.g., acetone, is generally used as a nail polish remover to dissolve the hardened film left on the nails by the ingredients in nail polish. The nail polish remover is typically dispensed from a bottle onto a sponge or pad which then can be used to wipe the nails. This process, often results in spillage or splashing of the nail polish remover solution onto the user's fingertips, skin, and/or clothes, or other inadvertent exposure of the skin to the solution. For example, while removing nail polish on the toenails, a user may ruin nail polish already applied to the fingers by splashing or spilling solvent, or by merely holding a sponge or pad saturated in solvent. Also, such methods often require resorting to a nail file or other tool to scrape the last traces of nail polish from the edges of the nails.

It would therefore be desirable to provide a product that can remove nail polish from the nails that minimizes the user's exposure to the nail polish remover solution. Thus, a nail polish remover kit solving the aforementioned problems is desired.

SUMMARY

A nail polish removal kit includes a bottle, a removable lid on the bottle, a wand extending from the lid into the bottle, and one or more flexible daubers. The bottle has an upper portion having a first diameter, a lower portion having a second diameter that is larger than the first diameter, and a neck portion between the upper portion and the lower portion. The lower portion is configured to hold a volume of nail polish remover solution. The neck portion has a diameter that is less than the diameter of the upper portion and the diameter of the lower portion. A tubular passageway with a constant diameter is provided within the neck portion. The wand has a free end with an opening extending therethrough.

A user can insert one of the daubers within the opening of the wand and use the wand to immerse the dauber in the nail polish remover in the lower portion. After immersing the dauber in the nail polish remover, the user can lift the wand and, thereby, force the dauber through the passageway to squeeze out excess solvent retained therein. In this manner, the user can apply the nail polish remover to the nails without handling the dauber directly and with minimal risk of exposing the skin to the nail polish remover. In addition, the user will avoid accidental spills and splashing since nail polish remover will not need to be poured out of the container.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
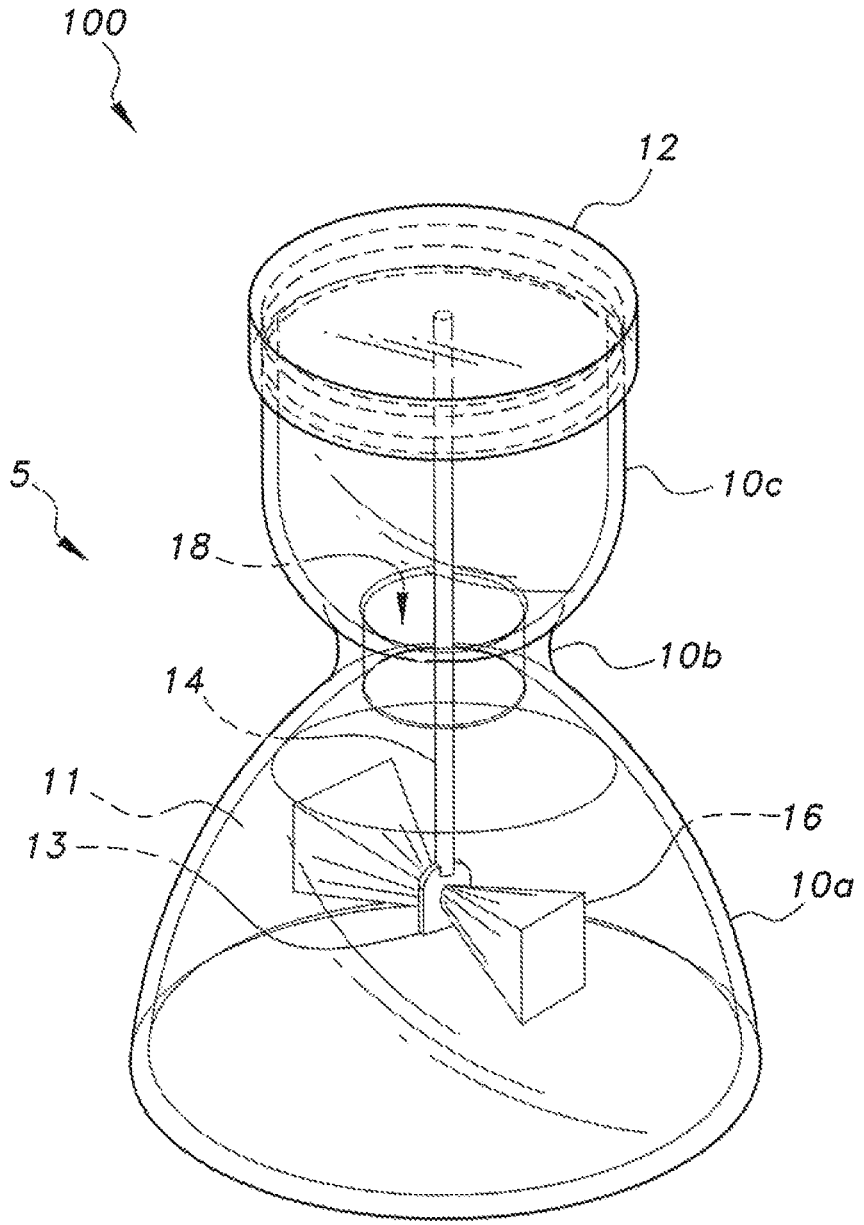
FIG. 1 is a perspective view of a first embodiment of the nail polish removal kit showing the wand and dauber extending into the lower reservoir portion of the bottle.

An embodiment of the nail polish removal kit 100 is shown in FIG. 1. As shown in FIG. 1, the nail polish removal kit 100 can include a bottle 5, a removable lid 12 on the bottle, a wand 14 extending from the lid 12 into the bottle 5, and one or more flexible daubers 16. The bottle 5 has a generally hourglass shape with an upper, open end and an opposing lower, closed end. The bottle 5 has an upper portion 10*c* having a first diameter, a lower portion 10*a* having a second diameter that is larger than the first diameter, and a neck portion 10*b* between the upper portion 10*c* and the lower portion 10*a*. The neck portion 10*b* has a third diameter that is less than the first diameter and the second diameter. A tubular passageway 18 with a constant diameter is provided within the neck portion 10*b*. The wand 14 can have a free end 13 with an opening extending therethrough. One of the daubers 16 can be supported within the opening at the free end 13 of the wand 14. The lower portion 10*a* houses nail polish remover solution 11. While lid 12 is in the closed position over the bottle 5, the dauber 16 supported by the wand 14 is immersed in the nail polish remover solution 11. The remaining daubers 16 can be stored in the upper portion 10*c*. Preferably, the daubers include a compressible absorbent, e.g., a foam or a sponge material.

Figure 7:
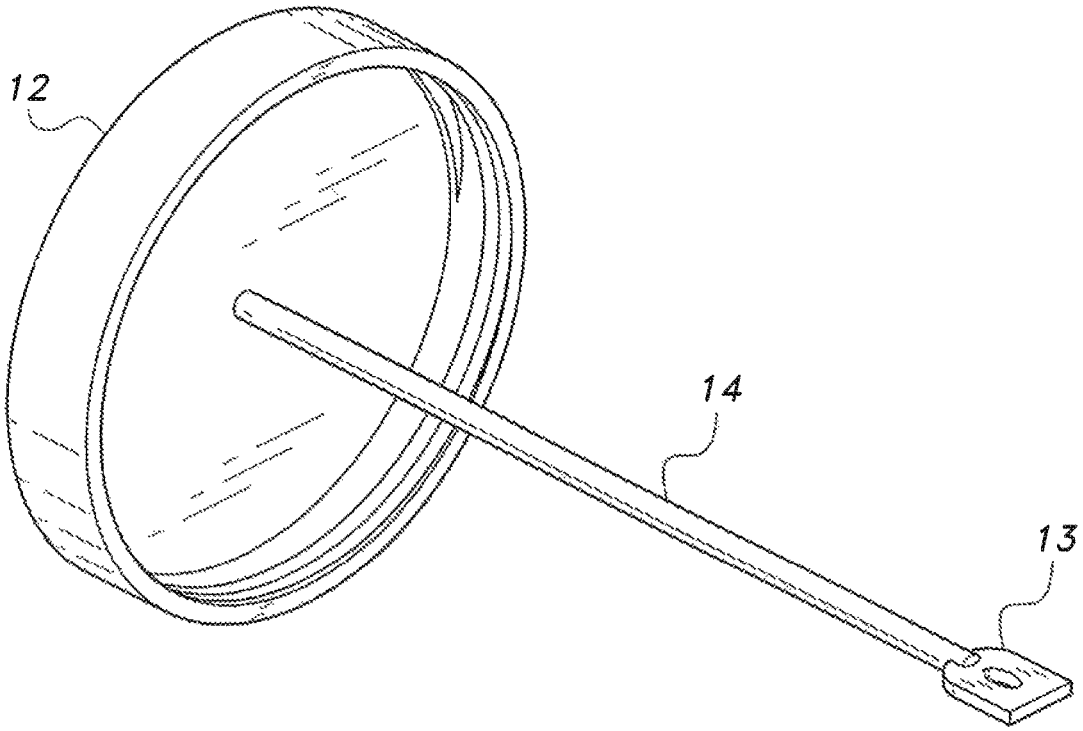
FIG. 7 is a perspective view of an embodiment of a lid with attached wand.

The passageway 18 of the neck portion 10*b* is narrower than a length and/or width of the dauber 16. To attach the dauber 16 to the wand 14, a first end of the dauber 16 is compressed and threaded through the hole in the scraper 22 (as best seen in FIG. 7) until the wand 14 is in the center of the dauber 16. When the wand 14 is lowered into or lifted out of the lower portion 10*a*, the dauber 16 is folded and/or compressed to pass through the passageway 18. For example, once the dauber 16 absorbs the nail polish remover 11 in the lower portion 10*a*, the dauber 16 is compressed in the passageway 18 to squeeze out excess solvent. The size of the passageway 18 is configured to remove enough solvent from the dauber 16 so that solvent is not dripping from the dauber 16 once the dauber 16 has passed through the neck portion 10*b* but enough solvent is retained for removing nail polish. Accordingly, the size and diameter of the passageway 18 of the neck portion 10*b* and size of the dauber 16 may be optimized for the desired solvent retention of the dauber 16. For example, an increase in length of the passageway 18 and/or a decrease in the diameter of the passageway 18 will increase the amount of solvent removed from the dauber.

A wall thickness of the bottle 5 may vary. As seen in FIG. 4, and also FIGS. 1-3, a wall thickness of the neck portion 10*b* can be greater than wall thicknesses of the upper and lower bottle portions. In some embodiments, the thickness of wall in the neck portion 10*b* may be in the range of 1.5 to 10 times greater than the thickness of the bottle 5 wall in the other portions 10*a*, 10*c*. The thickness of the wall at ends of the neck portion 10*b* may be thicker than the thickness of the wall in the center of the neck portion 10*b* to provide a constant diameter passageway 18, while maintaining the outer hourglass shape of the bottle 5. In this way, the passageway 18 can be generally tubular, having a constant diameter, while a corresponding portion of the outer surface of the bottle 5 can be generally curved. As seen in FIG. 4, the constant diameter cylindrical passageway 18 may gradually taper out at its ends to match the outer wall curves of the adjacent lower and upper portions 10*a*, 10*c*. The gradual taper will allow the dauber 16 to pass into and out of the neck portion 10*b* more smoothly and without risking damage to the walls of the bottle 5.

Figure 2:
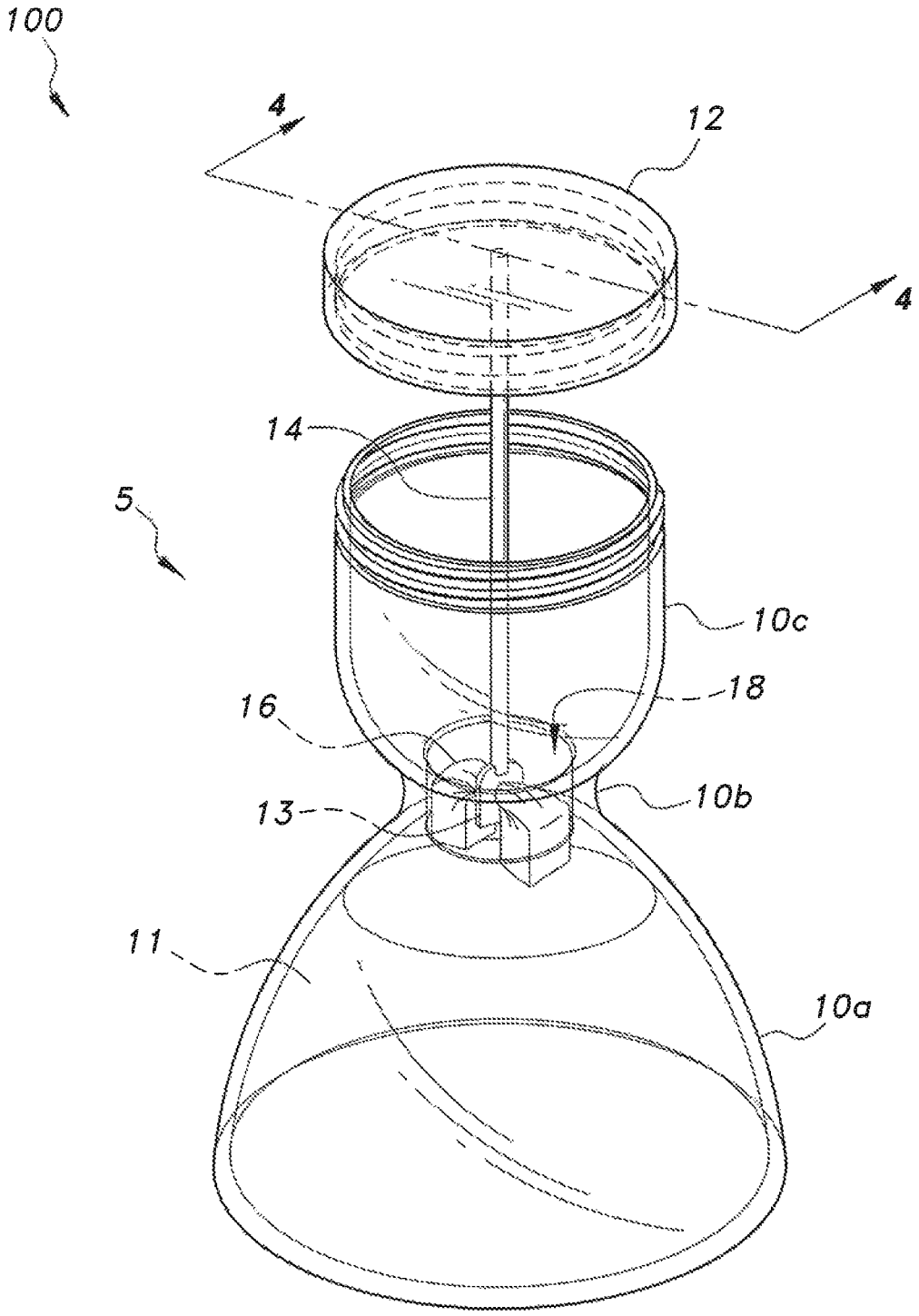
FIG. 2 is a perspective view of the first embodiment of the nail polish removal kit showing the dauber being pulled through the neck portion of the bottle by the wand.
Figure 3:
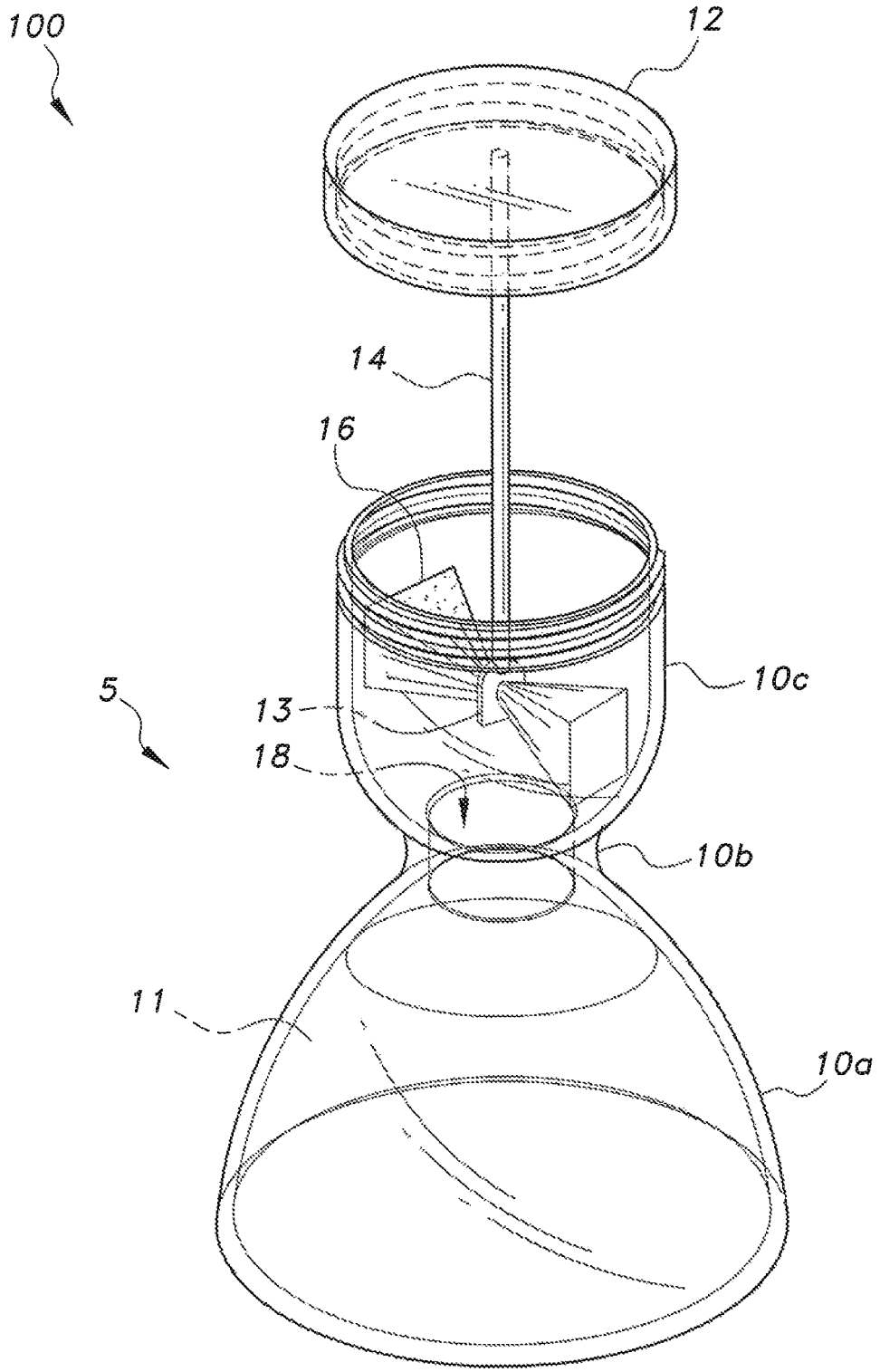
FIG. 3 is a perspective view of the first embodiment of the nail polish removal kit showing the wand and dauber extending into the upper containment portion of the bottle.
Figure 4:
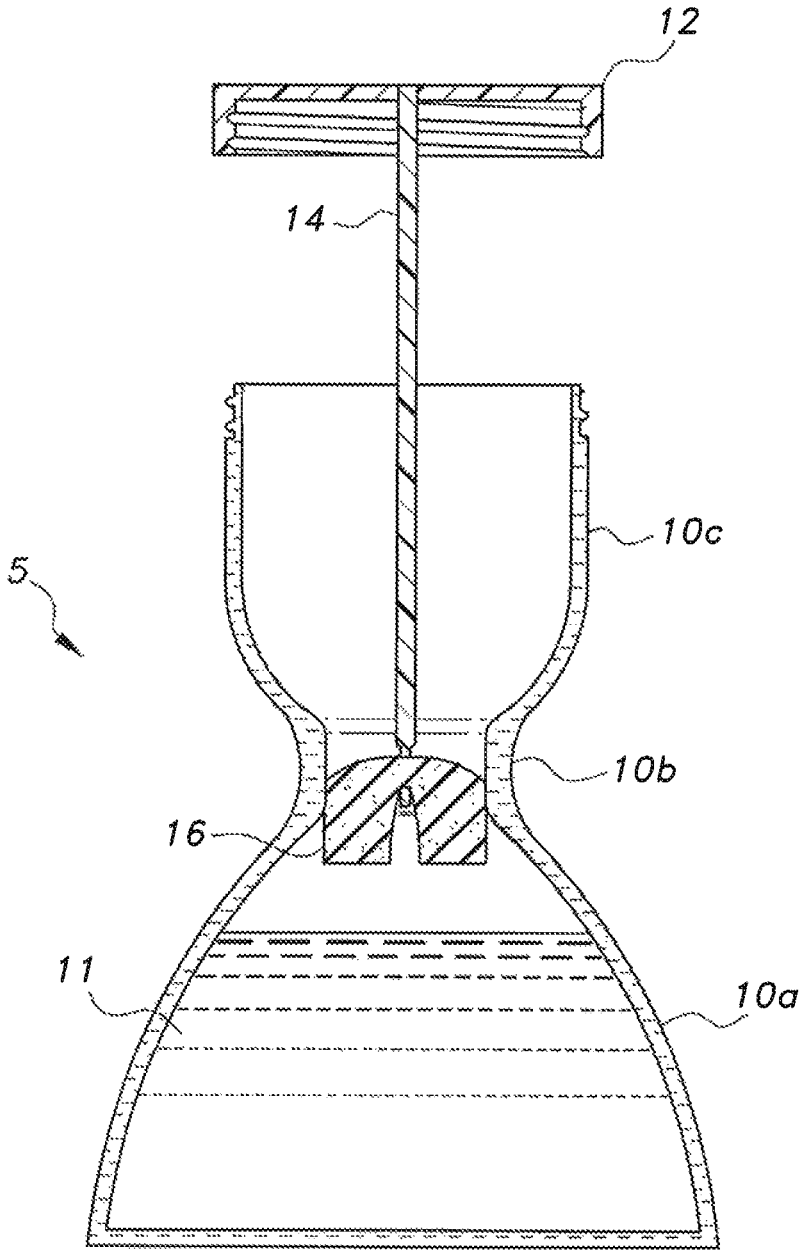
FIG. 4 is a cross-sectional view of the first embodiment of the nail polish removal kit showing the dauber being pulled through the neck portion of the bottle by the wand.

FIGS. 1-3 show the process of removing the dauber 16 from the bottle 5. In FIG. 1, when the dauber 16 (supported by the wand 14) is lowered into the lower reservoir portion 10*a*, the dauber 16 is submerged in the solvent and absorbs the solvent. When the dauber 16 is initially lifted from the solvent, it is saturated with solvent. This fully saturated state is undesirable for the user because solvent will drip out of the dauber 16 and end up in undesirable locations such as on the user's skin or clothes. In addition, a fully saturated dauber 16 will hold much more solvent than is necessary to remove the nail polish. Thus, as shown in FIG. 2, as the dauber 16 moves through the passageway 18, the ends of the dauber are folded and the dauber 16 is compressed to release excess solvent from the dauber 16 back into the reservoir portion 10*a*. When the dauber 16 is removed from the neck portion 10*b*, additional solvent droplets can be released from the dauber 16 as the dauber 16 unfolds to its expanded, original state. As such, the upper containment portion 10*c* of the bottle 5 is configured to allow the dauber 16 to fully expand therein so that these additional solvent droplets can be retained within the bottle rather than escaping out of the bottle (FIG. 3). By allowing the dauber 16 to fully expand within the upper containment portion 10*c*, splatter or droplets released from the dauber 16 rebounding to its expanded configuration will be contained by the bottle 5 walls. The upper containment portion 10*c* can also be used to store additional daubers for later use (see FIG. 5), as the passageway 18 of the central compression portion 10*b* is too small for the daubers to fall there-through.

Figure 5:
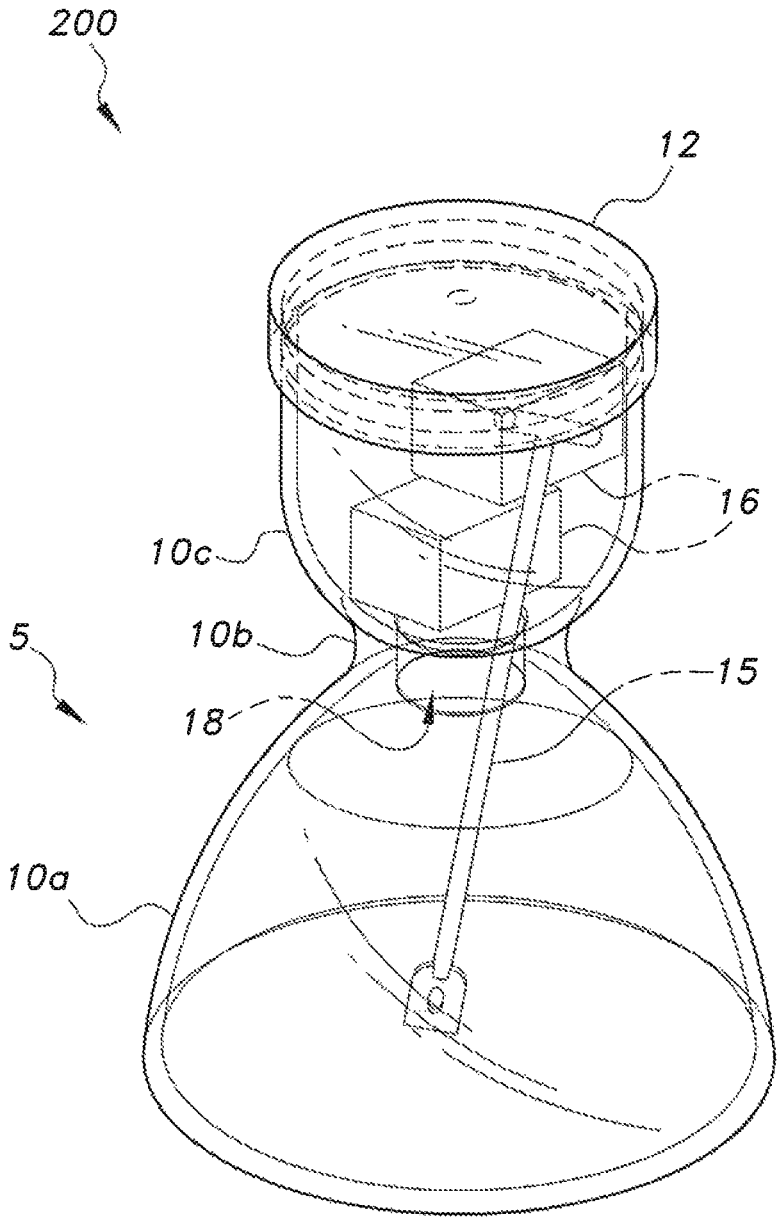
FIG. 5 is a perspective view of an embodiment of a kit for nail polish removal with detached wand.

FIG. 5 shows an alternate embodiment of the nail polish removal kit 200 in a storage state. As seen in FIG. 5, the lid 12 is tightly screwed onto the bottle 5 to create an air and liquid tight seal. In this embodiment, the wand 15 is not attached to the lid 12. The lower end of the wand 15 rests on the bottom end of the bottle 5 while the handle rests near the upper opening for easy access by a user. Extra daubers 16 are stored in the upper containment portion 10*c*, allowing for multiple polish removals without the need for additional items.

Figure 6A:
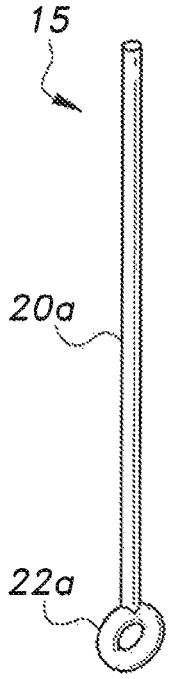
FIGS. 6A-6D show different embodiments of the wand.
Figure 6B:
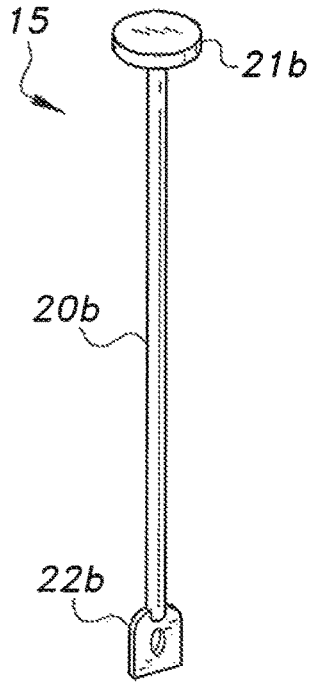
Figure 6C:
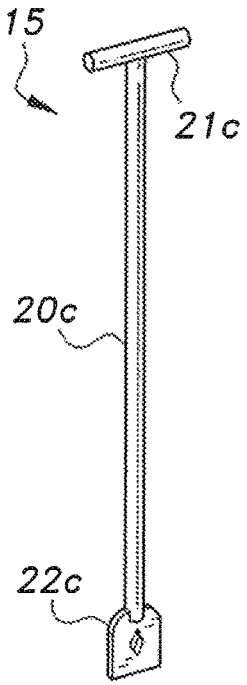
Figure 6D:
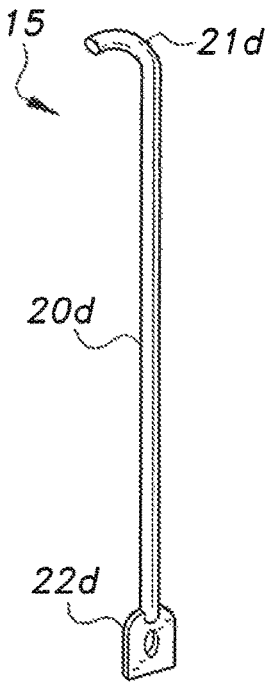

Exemplary configurations of the free wand are depicted in FIGS. 6A-D. FIG. 6A shows the free wand 15 having a shaft 20*a* and a round or donut-shaped lower end 22*a* with an opening for receiving a dauber 16 therethrough. FIG. 6B shows the free wand 15 having a disk shaped handle 21*b* at one end and a scraper 22*b* with a straight edge at another end. The edge of the scraper 22*b* can be used for scraping off nail polish that may be difficult to remove with the dauber 16 alone. The scraper 22*b* can include a hole for holding the dauber 16. The free wand 15 depicted in FIG. 6C has a T shaped handle 21*c* and a diamond shaped hole in the scraper 22*c*. The diamond shaped hole may prevent axial rotation of a dauber 16 having a diamond or square cross section. FIG. 61) shows the free wand 15 having a J-shaped handle 21*d*. Various alternative combinations of handle and donut-shaped or scraper ends are also contemplated.

The attached wand 14, described previously, may also include the donut-shaped or scraper ends. FIG. 7 shows an embodiment of a lid 12 with attached wand 14. The wand 14 includes a scraper lower end and a hole extending there-through. The inner rim of the lid 12 is threaded for a threaded connection with the upper opening of the bottle 5. The lower surface of the top of the lid 12 may include an O-ring or sealing gasket to create an air and liquid tight seal between the upper rim of the bottle 5 and the lid 12.

Figure 8:
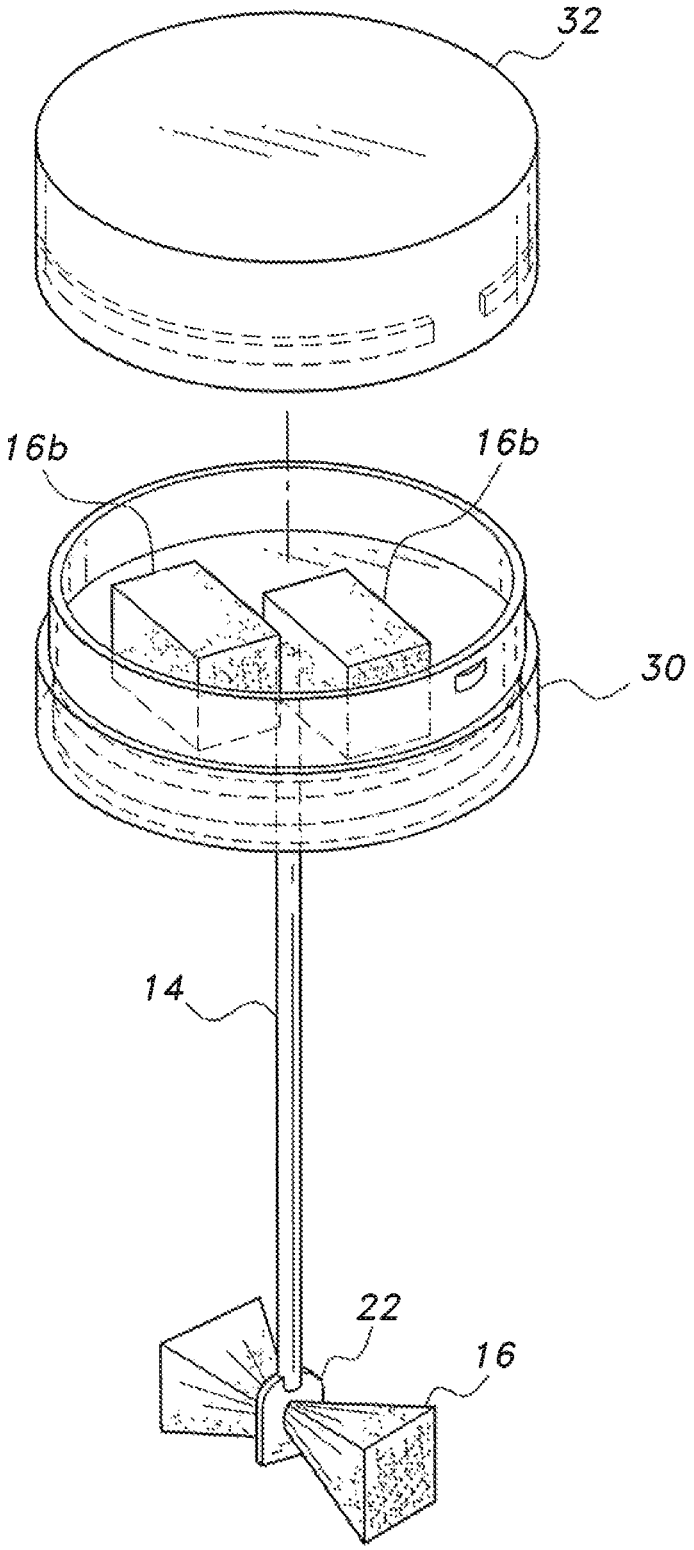
FIG. 8 is a perspective view of an embodiment of a lid having an upper compartment with an attached wand.

FIG. 8 shows an alternative embodiment of a lid 30 with attached wand 14. In this embodiment, the lid 30 includes an upper removable cap 32 and an upper compartment for holding additional accessories, such as extra daubers 16. Since an air and liquid tight seal is not necessary between the cap 32 and the lid 30, snap on or threaded connections may be used to attach the cap 32 to the lid 30. The upper compartment also provides a storage area that is not exposed to solvent, unlike the upper containment portion of the container. As shown in FIG. 8, the dauber 16 is threaded through the hole in the wand 14.

The lower reservoir 10*a* can have a capacity ranging from about 6 ounces to about 16 ounces. A ratio of the dauber 16 width to the width of the passageway 18 may be in the range of 0.75:1 through 3:1. In embodiments where the width of the dauber 16 is less than or equal to the width of the passageway 18 but the length of the dauber 16 is greater than the width of the passage way, the dauber 16 can still be compressed when pulled through the passageway 18 because the two ends of the dauber 16 will be folded down by the walls of the passageway 18. A ratio of the inner width of the upper containment portion 10*c* to the length of the dauber 16 may be 1:1 to 1:2. A ratio of the width of the upper containment portion 10*c* to a width of the lower reservoir 10*a* may be in the range of 1:1.5 to 1:2.5. The ratio can be selected based on solvent capacity, which will increase or decrease with a width of the lower reservoir portion 10*a*, and storage capacity which will increase or decrease with a width of the upper containment portion 10*c*. The aforementioned ratios are merely examples and are not intended to be limiting.

An embodiment may include the following dimensions: a width of the dauber 16 may be ⅞ of an inch, a length of the dauber 16 may be 1 inch, a width of the passageway 18 in the neck portion 10*b* may be ½ of an inch, the length of the passageway 18 in the neck portion 10*b* may be ⅝ of an inch, a height of the hole in the wand 14 for receiving the dauber 16 may be 7/16 of an inch, a width of the hole in the wand 14 for receiving the dauber 16 may be 3/16 of an inch, a width of the scraper at the end of the wand 14 may be 6/16 of an inch, a diameter of the upper opening in the bottle 5 may be 1 and 10/16 of an inch, a height of the upper containment portion 10*c* may be 1 inch, and a diameter of the base of the bottle 5 may be 3 inches.

The dauber 16 may be made out of any resilient material that can absorb and redistribute solvent. For example, the dauber 16 may be a conventional sponge made out of polyester. The dauber 16 may be shaped as a cylinder, a triangular prism, or a rectangular prism. The bottle 5, lid 12, and wand 14 may be made out of a polymer, such as high density polyethylene, a metal, such as aluminum, glass, ceramic, or combinations thereof.

The solvent held within the bottle 5 may be acetone, ethyl acetate, isopropyl alcohol, or propylene carbonate. Other liquids known in the art for removal of nail polish or softening of cuticles, such as oils and emulsions, may also be used in the kit.

It is to be understood that the present subject matter is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A nail polish removal kit, comprising:

a bottle having an upper portion with a first diameter, a lower portion with a second diameter larger than the first diameter, and a neck portion with a third diameter, the neck portion being disposed between the upper portion and the lower portion and having a diameter less than the first diameter and the second diameter;

a lid removably attached to the upper portion; and a wand, the wand having a first end and a second end, the first end being unattached and including an opening extending therethrough and the second end being unattached.

2. The nail polish removal kit of claim 1, further comprising a tubular passageway within the neck portion, the tubular passageway having a constant diameter.

3. The nail polish removal kit of claim 1, wherein the wand includes a second end, the second end being attached to the lid.

4. The nail polish removal kit of claim 3, wherein the first end of the wand includes a straight edge for scraping nail polish.

5. The nail polish removal kit of claim 4, wherein the first end of the wand is round.

6. The nail polish removal kit of claim 1, wherein the first end of the wand includes a straight edge for scraping nail polish and the second end includes a handle.

7. The nail polish removal kit of claim 1, wherein the first end of the wand is round and the second end includes a handle.

8. The nail polish removal kit of claim 1, wherein a thickness of a wall of the bottle varies along a height of the bottle.

9. The nail polish removal kit of claim 8, wherein the wall thickness of the neck portion is greater than the wall thickness of the upper portion.

10. The nail polish removal kit of claim 8, wherein the wall thickness of the neck portion is greater than the wall thickness of the lower portion.

11. The nail polish removal kit of claim 1, wherein a length of the wand is greater than the combined height of the lower portion and upper portion of the container.

12. The nail polish removal kit of claim 1, wherein the lid comprises a storage compartment and a removable cap for covering the storage compartment.

13. A nail polish removal kit, comprising:

a bottle having an upper portion with a first diameter, a lower portion with a second diameter larger than the first diameter, and a neck portion with a third diameter, the neck portion being disposed between the upper portion and the lower portion and having a diameter less than the upper portion and the lower portion;

a tubular passageway extending within the neck portion, the passageway having a constant diameter;

a lid removably attached to the upper portion, wherein the lid comprises a storage compartment and a removable cap for covering the storage compartment; and a wand having a first end, the first end being unattached and including an opening extending therethrough.

14. The nail polish removal kit according to claim 13, wherein the wand includes a second end, the second end being attached to the lid.

15. The nail polish removal kit according to claim 13, wherein the wand includes a second end, the second end being unattached and including a handle.

16. The nail polish removal kit of claim 13, wherein a wall thickness of the neck portion is greater than a wall thickness of at least one of the upper portion and the lower portion.

17. The nail polish removal kit of claim 13, wherein the lower portion comprises a volume of nail polish remover solution.

* * * * *